US008523182B2

(12) United States Patent
Goldman

(10) Patent No.: US 8,523,182 B2
(45) Date of Patent: Sep. 3, 2013

(54) RING PUZZLE

(76) Inventor: Igor Goldman, Montgomery Village, MD (US)

( * ) Notice: Subject to any disclaimer, the term of this patent is extended or adjusted under 35 U.S.C. 154(b) by 158 days.

(21) Appl. No.: 13/224,216

(22) Filed: Sep. 1, 2011

(65) Prior Publication Data

US 2013/0056930 A1 Mar. 7, 2013

(51) Int. Cl.
*A63F 3/00* (2006.01)

(52) U.S. Cl.
USPC ..... 273/156; 273/153 R

(58) Field of Classification Search
USPC ..... 273/156, 153 R
See application file for complete search history.

(56) References Cited

U.S. PATENT DOCUMENTS 3,970,314 A * 7/1976 Mayr et al. ..... 273/156
7,252,204 B1 * 8/2007 Small ..... 215/206

* cited by examiner

*Primary Examiner* — Vishu K. Mendiratta

(57) ABSTRACT

A ring puzzle has a plurality of rings having a through going slot through which the rings can be introduced into one another, and each of the ring being provided with a plurality of groups at least two circumferentially spaced protrusions and at least two axially spaced grooves, such that when one of the rings is introduced in another of the rings and turned relative to the latter and the protrusions of one of the rings are engaged in the grooves of another of the rings at least one of the groups two of the rings become firmly connected with one another.

7 Claims, 15 Drawing Sheets

13

14

RING PUZZLE

BACKGROUND OF THE INVENTION

The present invention relates generally to games, puzzles and other entertainment devices which involve assembly and disassembly of individual elements.

Numerous articles of this type have been designed, and manufactured, and are currently in use. It is believed that it is advisable to provide a new article, which essentially is a ring puzzle, which is different from the existing puzzles.

SUMMARY OF THE INVENTION

It is an object of the present invention to provide a new entertaining game article which is attractive, interesting and challenging.

In keeping with these objects, one feature of the present invention resides in a ring puzzle, comprising a plurality of rings, each of said rings having a through going slot through which said rings can be introduced into one another, each of said ring being provided on its inner surface with a plurality of groups at least two peripherally spaced protrusions and at least two transversely spaced grooves, such that when one of said rings is introduced in another of said rings and turned relative to the latter and said protrusions of one of said rings are engaged in said grooves of another of said rings of at least one of said groups said two rings become firmly connected with one another.

Another feature of the invention resides in said protrusions extend from said inner surface of each of said rings and are rounded at their ends spaced from said inner surface.

Another feature of the invention resides in a reinforcing rib provided on said inner surface of each of said rings and extending between said groups in a peripheral direction.

Still a further feature of the present invention resides in a plurality of ring-shaped labels each provided on its outer surface with elements selected from the group consisting of colors, indexes, numbers and combinations thereof and arranged with its inner surface on a an outer surface of respective one of said rings in correspondence with locations of said groups of said two protrusions.

DESCRIPTION OF THE PREFERRED EMBODIMENTS

Figure 1:
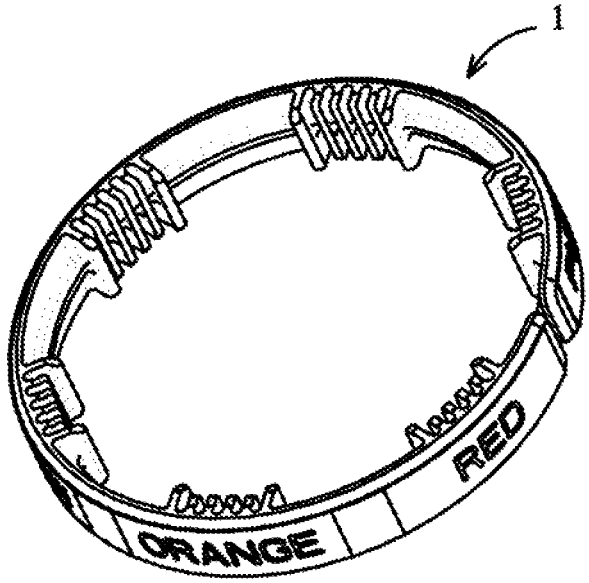
FIG. 1 is a view showing a hexagon ring assembly puzzle in a perspective view in accordance with the present invention.

The ring puzzle in accordance with the invention includes a ring puzzle assembly 1 in accordance with the present invention as shown in FIGS. 1, 2, 6A and 6B comprising ring part 2, and label 3, locating on outside surface of ring part 2, with possibility to be locked with another ring assembly 1 by means of two peripherally spaced rounded and facing toward each other protrusions 4, located on inside surface of ring part 2 and two corresponding transversely spaced rounded grooves 5 facing toward each other and located on two opposite side surfaces of ring part 2 between rounded and facing toward each other protrusions 4, shown on FIGS. 4A, 4B, 5, 6B, 7. A plurality of groups of the protrusions 4 and the grooves 5 are provided in each ring part 2 and peripherally spaced from each other.

Ring part 2 has on inside surface circumferentially extending reinforcing rib 6 on both sides of protrusions 4 and flat surfaces 8 between protrusions 4. Flat surfaces 8 are peripherally rounded, as shown on FIGS. 5 and 7 for easy interaction and engagement with rounded protrusions 4. Protrusions 4 have rounded ends spaced from inner surface of each ring. Ring part 2 is interrupted by cut 9.

Cut 9 enhances flexibility of ring part 2 and allows access to engage it with another ring part 2.

Figure 2:
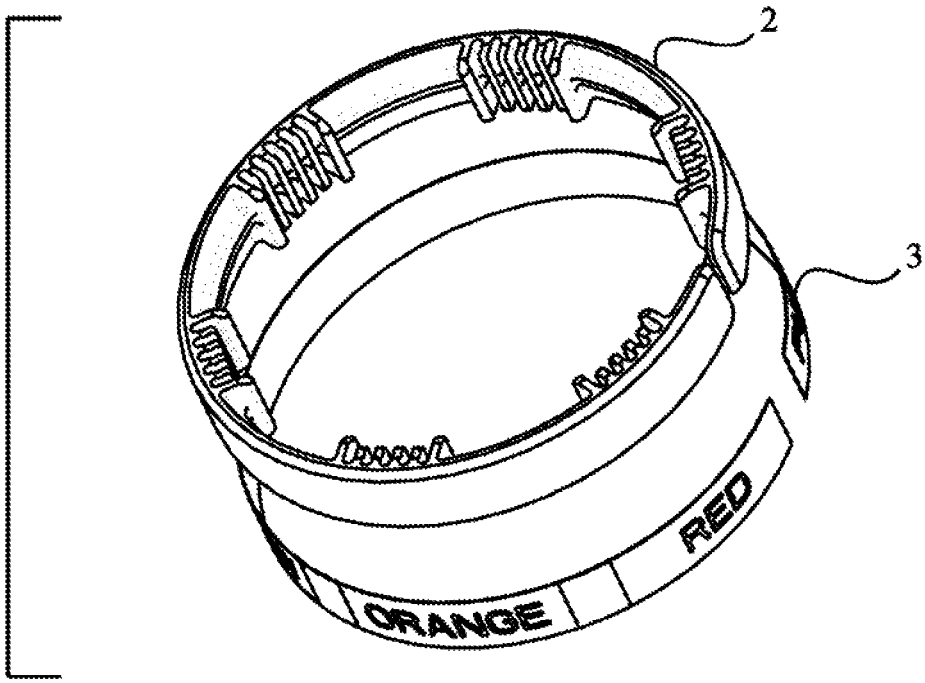
FIG. 2 is an exploded perspective view of the hexagon ring assembly puzzle.
Figure 3:
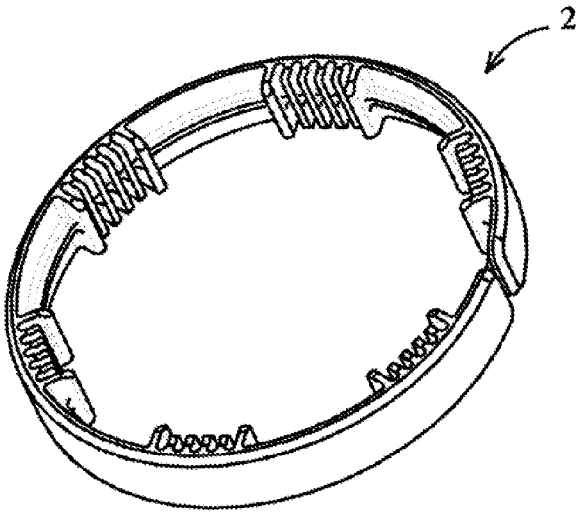
FIG. 3 is a perspective view of the hexagon ring part.
Figure 4A:
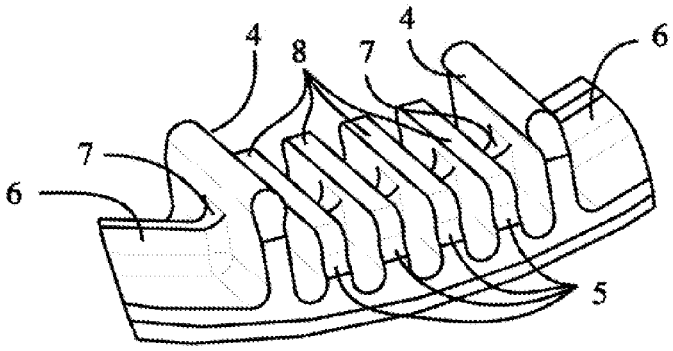
FIG. 4A is a perspective detailed partial view of one locking feature of the hexagon ring part on FIG. 3.
Figure 4B:
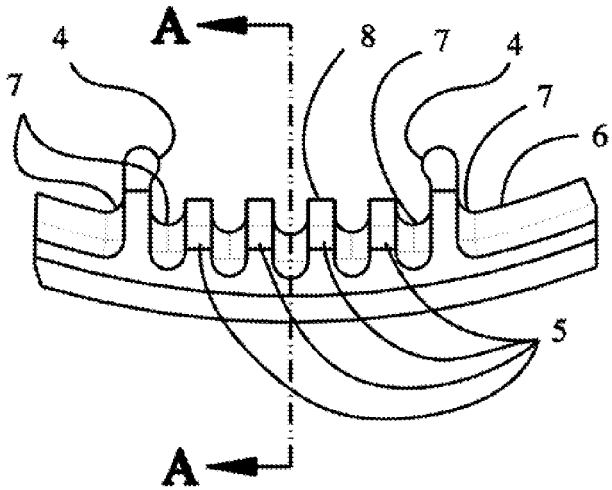
FIG. 4B is a planar detailed partial view of one locking feature of the hexagon ring part on FIG. 3.
Figure 5:
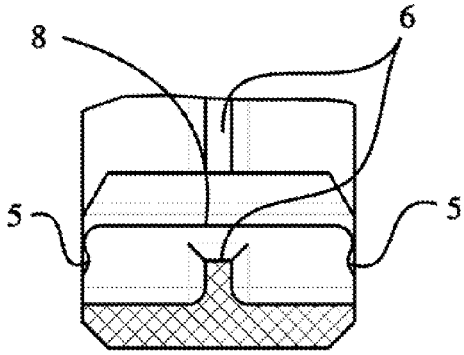
FIG. 5 is a sectional view of the hexagon ring part on FIG. 4B.
Figure 6A:
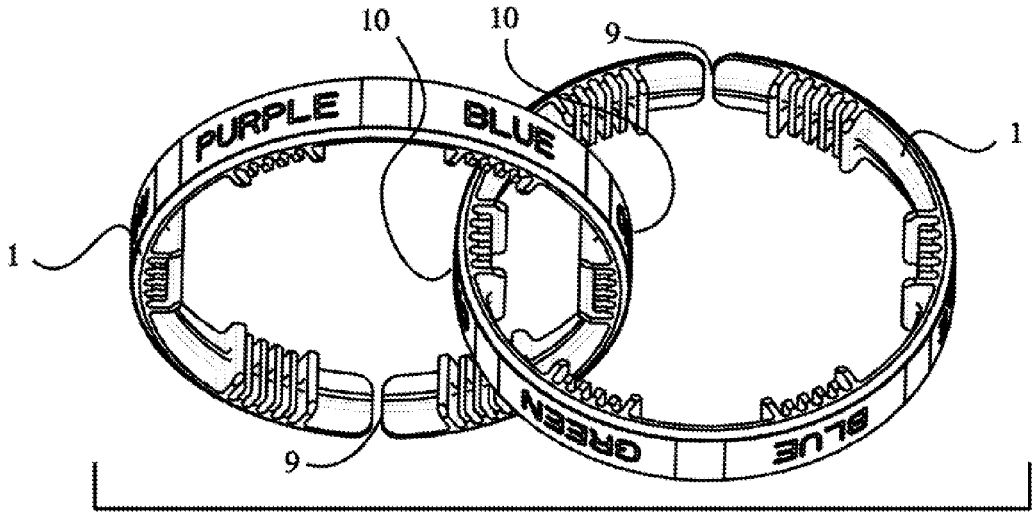
FIG. 6A is an exploded perspective view of the two hexagon ring assemblies in process to be locked together.
Figure 6B:
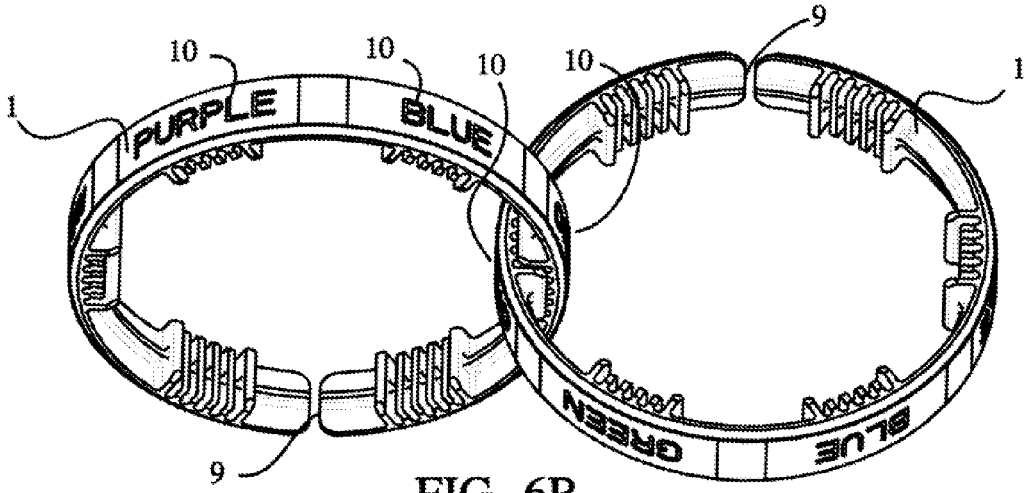
FIG. 6B is a perspective view of the two locked together hexagon ring assemblies on FIG. 6A.

Label 3, shown on FIG. 2, has on outside surface corresponding to each pair of protrusions 4 colors or indexes or numbers 10, shown on FIGS. 6A and 6B.

Reinforcing rib 6 is designed to reduce weight of ring part 2 and to make it at the same time not only flexible but also rigid.

Figure 7:
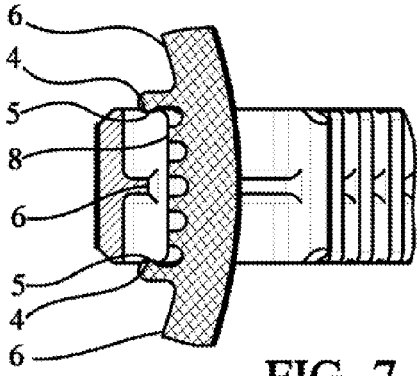
FIG. 7 is a partial sectional view of the two locked together hexagon ring assemblies on FIG. 6B.
Figure 8:
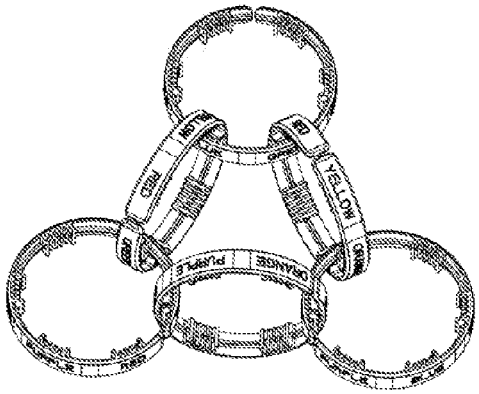
FIG. 8 is a perspective view of a sample of six hexagon ring assemblies locked together.
Figure 9:
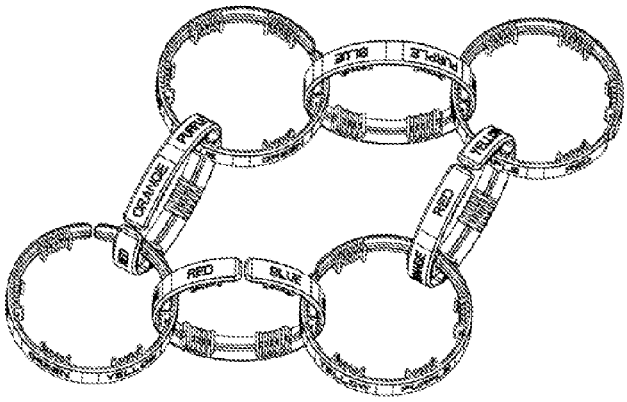
FIG. 9 is a perspective view of a sample of eight hexagon ring assemblies locked together.
Figure 10:
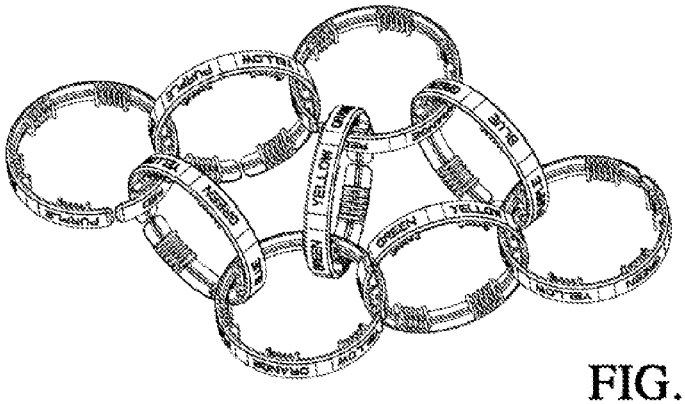
FIG. 10 is a perspective view of a sample of nine hexagon ring assemblies locked together.
Figure 11:
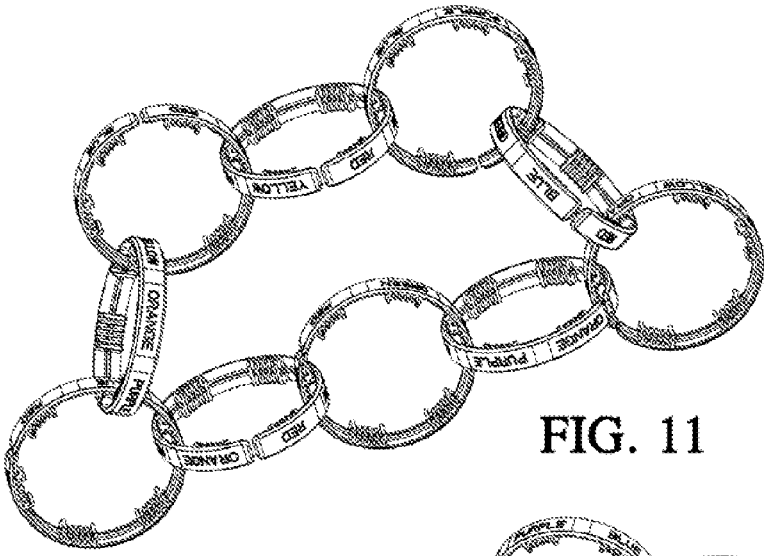
FIG. 11 is a perspective view of a sample of ten hexagon ring assemblies locked together.
Figure 12:
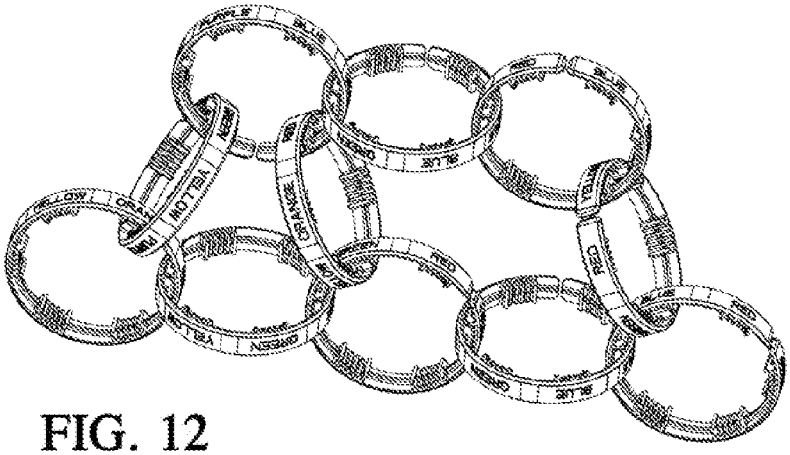
FIG. 12 is a perspective view of a first sample of eleven hexagon ring assemblies locked together.
Figure 13:
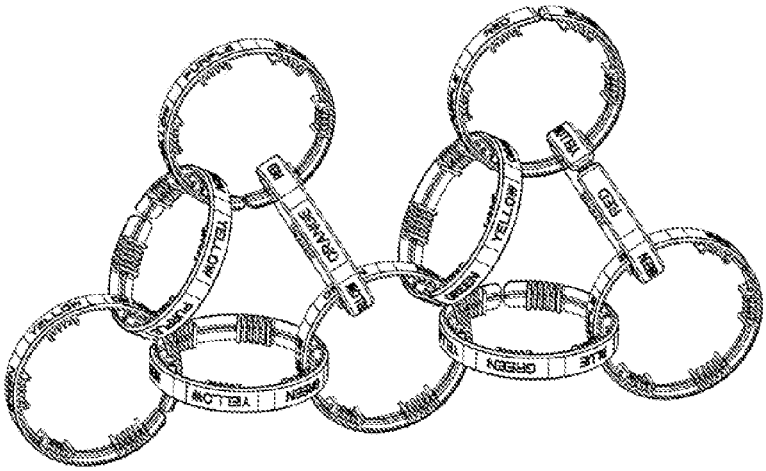
FIG. 13 is a perspective view of a second sample of eleven hexagon ring assemblies locked together.
Figure 14:
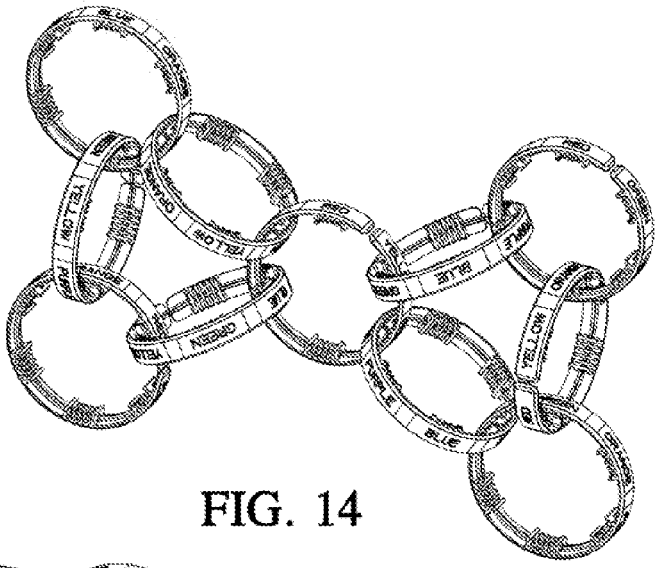
FIG. 14 is a perspective view of a third sample of eleven hexagon ring assemblies locked together.
Figure 15:
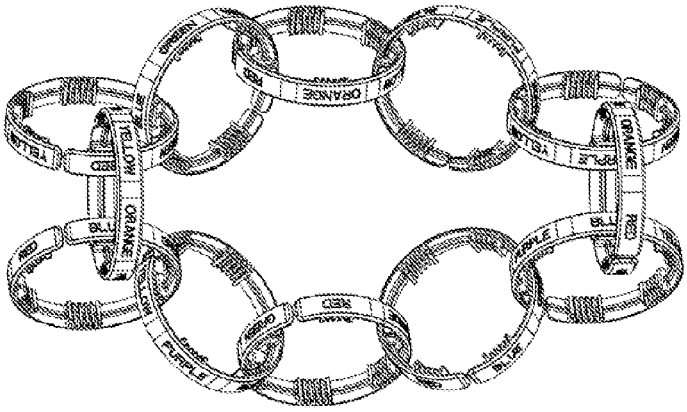
FIG. 15 is a perspective view of a first sample of twelve hexagon ring assemblies locked together.
Figure 16:
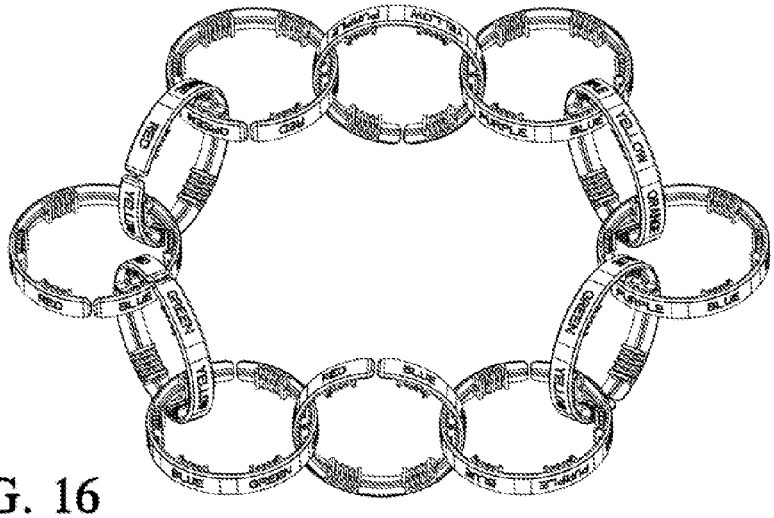
FIG. 16 is a perspective view of a second sample of twelve hexagon ring assemblies locked together.
Figure 17:
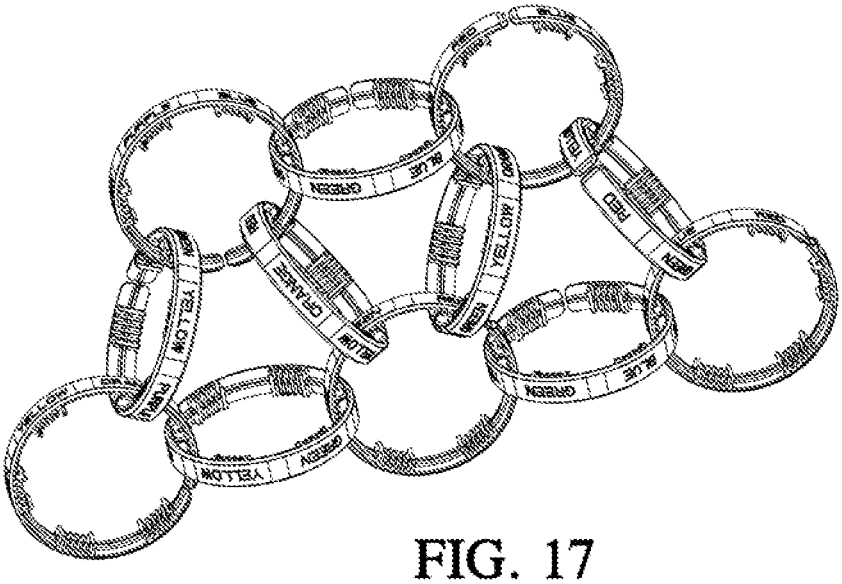
FIG. 17 is a perspective view of a third sample of twelve hexagon ring assemblies locked together.
Figure 18:
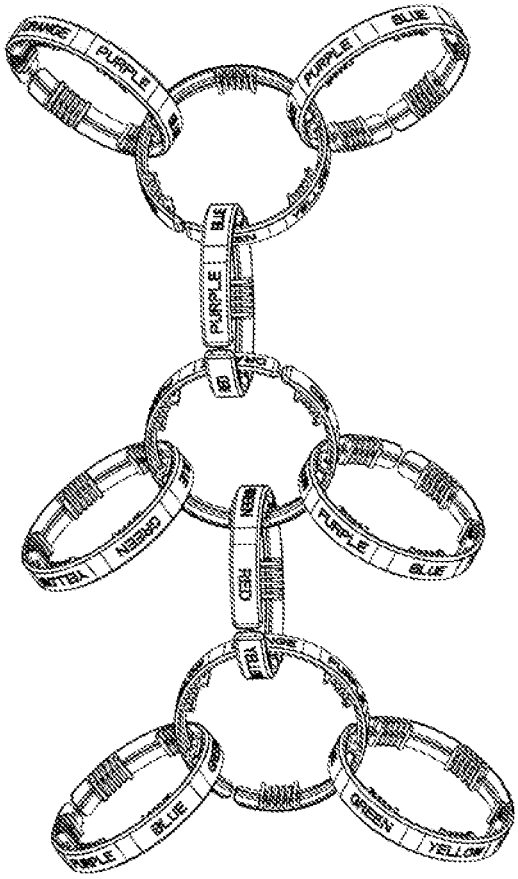
FIG. 18 is a perspective view of a "bear" figure made from eleven locked together hexagon ring assemblies.
Figure 19:
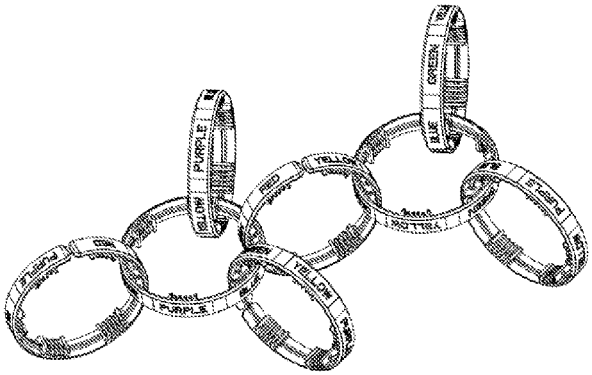
FIG. 19 is a perspective view of a "bug" figure made from eight locked together hexagon ring assemblies.
Figure 20:
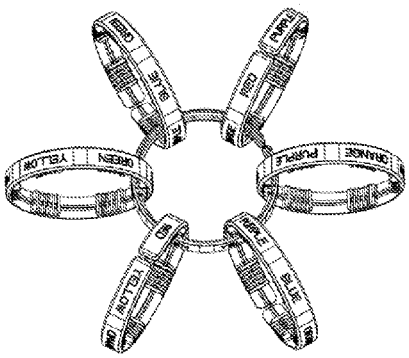
FIG. 20 is a perspective view of a "flower" figure made from seven locked together hexagon ring assemblies.
Figure 21:
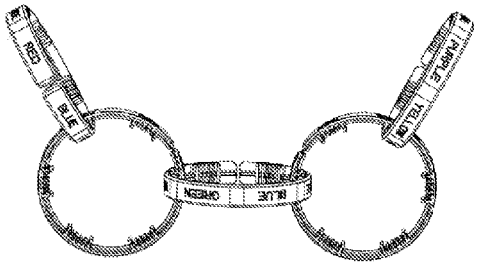
FIG. 21 is a perspective view of a "glasses" figure made from five locked together hexagon ring assemblies.
Figure 22:
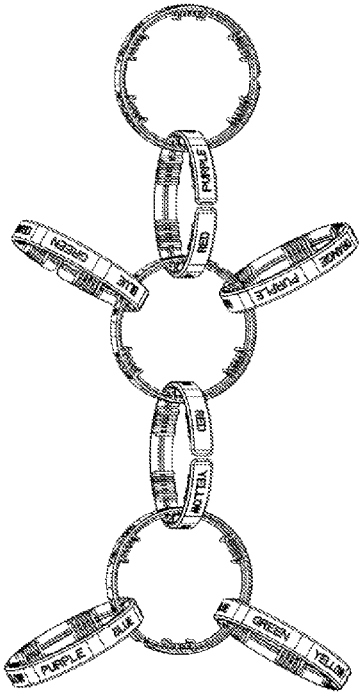
FIG. 22 is a perspective view of a "kid" figure made from nine locked together hexagon ring assemblies.
Figure 23A:
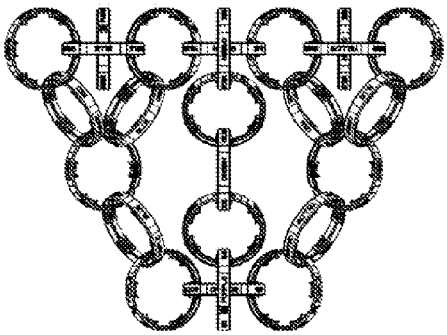
FIG. 23A is a front view of a "vase" figure made from fifty six locked together hexagon ring assemblies.
Figure 23B:
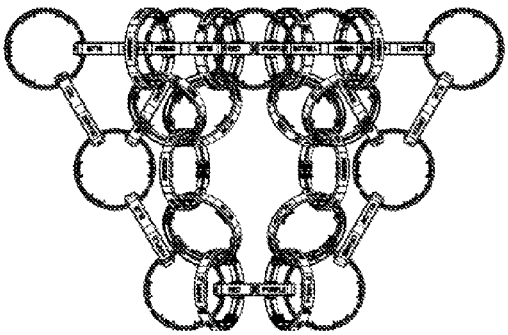
FIG. 23B is a right side view of a "vase" figure made from fifty six locked together hexagon ring assemblies on FIG. 23A.
Figure 23C:
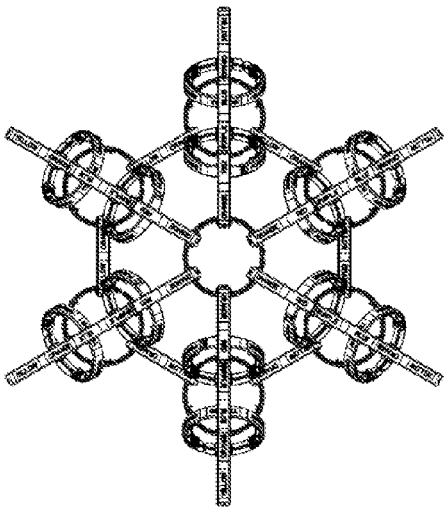
FIG. 23C is a bottom view of a "vase" figure made from fifty six locked together hexagon ring assemblies on FIG. 23A.
Figure 24A:
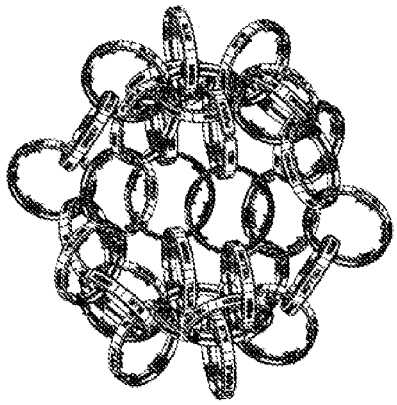
FIG. 24A is a perspective view of a "sphere" figure made from thirty two locked together hexagon ring assemblies.
Figure 24B:
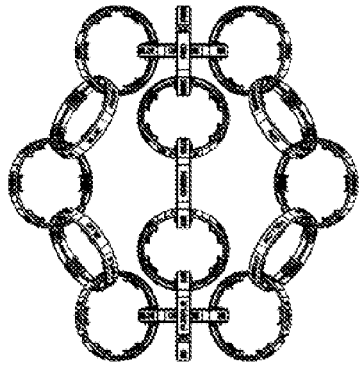
FIG. 24B is a front view of a "sphere" figure made from thirty two locked together hexagon ring assemblies on FIG. 24A.
Figure 24C:
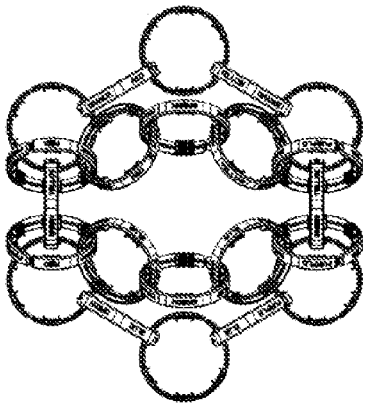
FIG. 24C is a left side rotated 90 degree view of a "sphere" figure made from thirty two locked together hexagon ring assemblies on FIG. 24B.
Figure 24D:
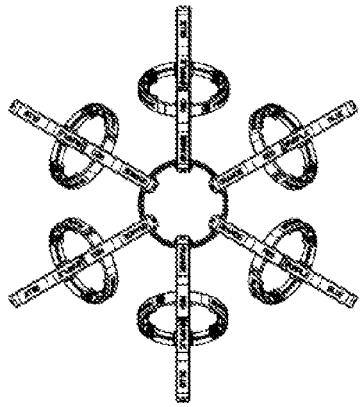
FIG. 24D is a bottom view of a "sphere" figure made from thirty two locked together hexagon ring assemblies on FIG. 24B.
Figure 25A:
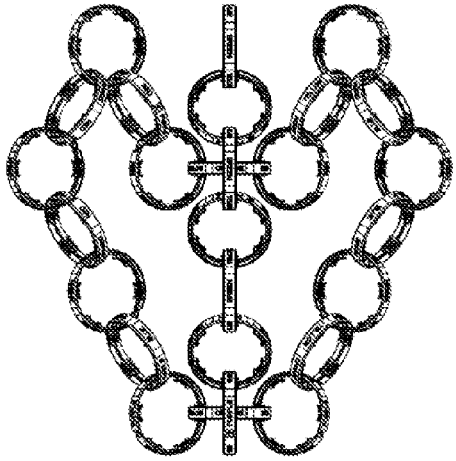
FIG. 25A is a front view of a "heart" figure made from fifty six locked together hexagon ring assemblies.
Figure 25B:
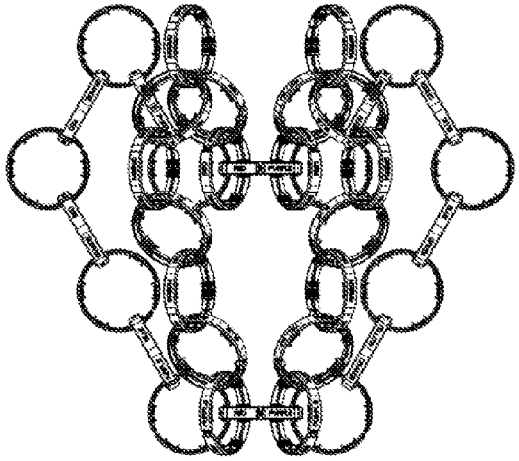
FIG. 25B is a right side view of a "heart" figure made from fifty six locked together hexagon ring assemblies on FIG. 25A.
Figure 25C:
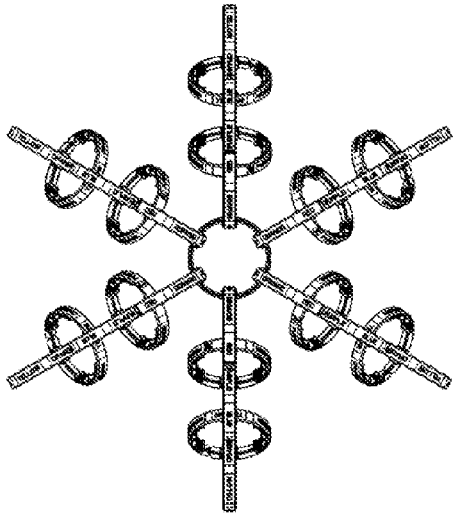
FIG. 25C is a bottom view of a "heart" figure made from fifty six locked together hexagon ring assemblies on FIG. 25A.

Flat surfaces 8, shown on FIG. 7, provided on projections on inside between rounded protrusions 4 are designed to provide two ring parts engagements strong and stable.

Radii 7 on both sides of rounded protrusions 4 are designed for molds adjustments to provide two ring parts 2 engagements strong and stable. Changing and moving these radii 7 up or down in molds will change flexibility of ejected with ring part 2 rounded protrusions 4 and add more or less force for engagement of two ring parts 2.

Strong and stable engagement of two ring parts 2 is provided by simultaneous mating surfaces 8 on both ring parts 2 and insertion of rounded protrusions 4, which are somewhat flexible, into grooves 5 as shown on FIG. 7.

Also as shown on FIG. 7 strong and stable engagement of two ring parts 2 is additionally provided by equal distance between flat surface 8 and center of rounded protrusions 4 and flat surface 8 and center of two corresponding transversely spaced rounded grooves 5 facing toward each other and located on two opposite side surfaces of ring part 2 between rounded and facing toward each other protrusions 4.

Figure 26A:
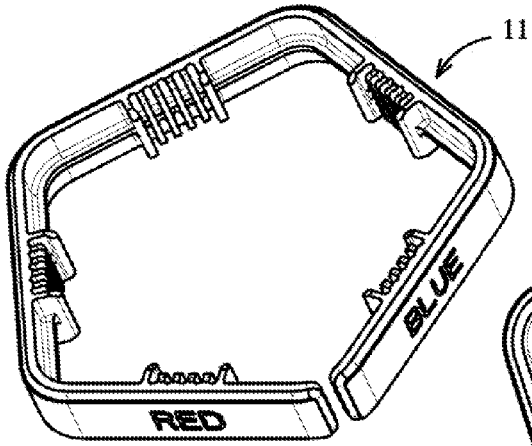
FIG. 26A is a view showing a pentagon ring assembly puzzle in a perspective view in accordance with the present invention.
Figure 26B:
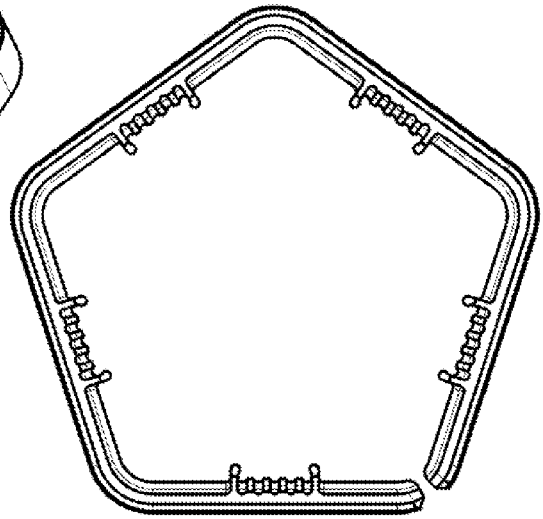
FIG. 26B is a front view of a pentagon ring assembly puzzle in accordance with the present invention on FIG. 26A.
Figure 29A:
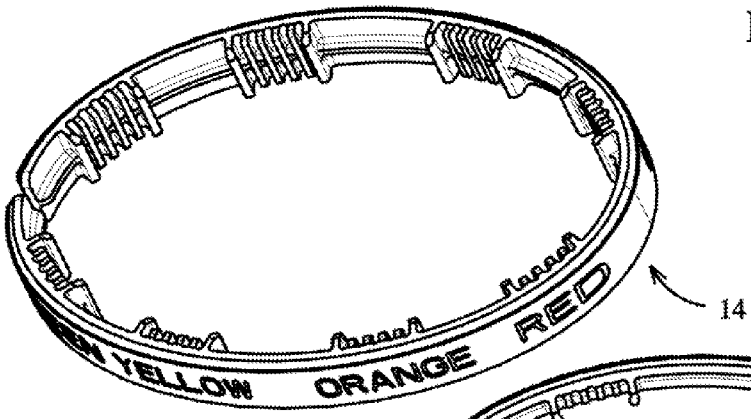
FIG. 29A is a view showing an elliptical shape octagon ring assembly puzzle in a perspective view in accordance with the present invention.
Figure 29B:
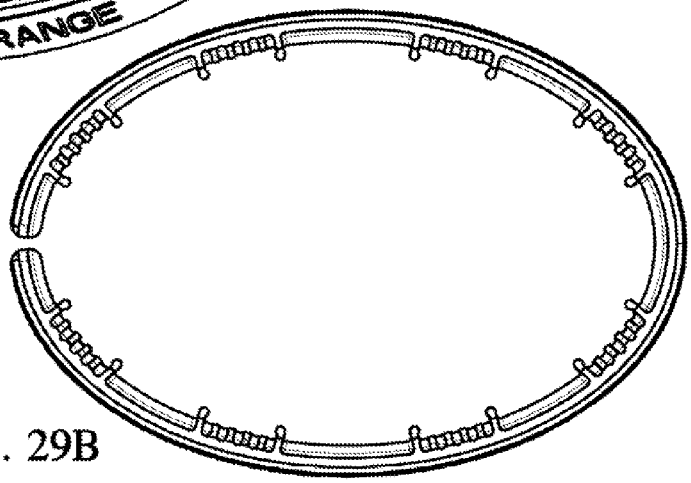
FIG. 29B is a front view of an elliptical shape octagon ring assembly puzzle in accordance with the present invention on FIG. 29A.
Figure 30A:
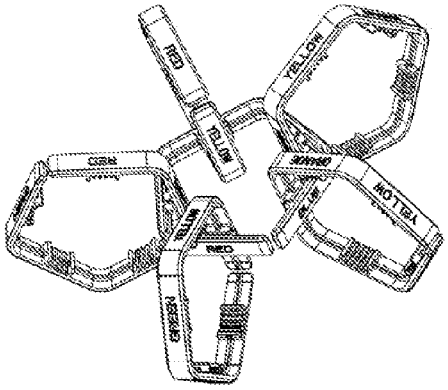
FIG. 30A is a perspective view of a "flower" figure made from six locked together pentagon ring assemblies.
Figure 30B:
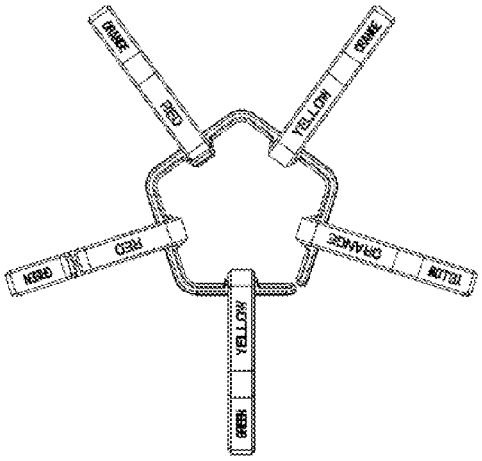
FIG. 30B is a front view of a "flower" figure made from six locked together pentagon ring assemblies on FIG. 30A.
Figure 31:
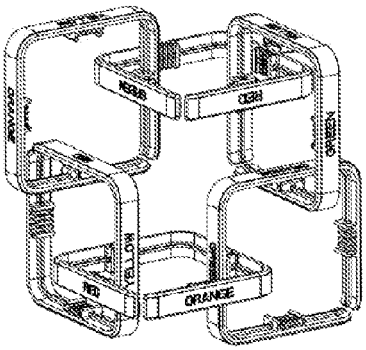
FIG. 31 is a perspective view of six square ring assemblies locked together in a "cube" figure.
Figure 32:
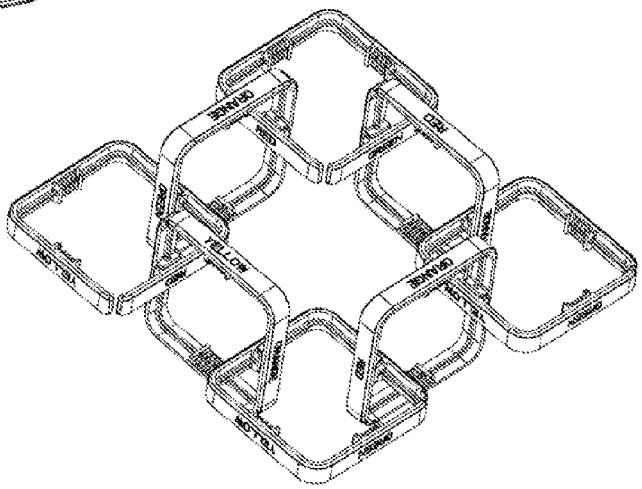
FIG. 32 is a perspective view of eight square ring assemblies locked together in a "cube" figure.

Shape of ring part 2 like a shape of ring puzzle assembly 1 can be any imaginable shape, for example circular as shown on FIG. 1 for ring assembly 1, pentagonal for ring assembly 11 shown on FIGS. 26A and 26B, rectangular for ring assembly 12 and 13 as shown on FIGS. 27A-28B, elliptical for ring assembly 14 as shown on FIGS. 29A and 29B.

Figure 27A:
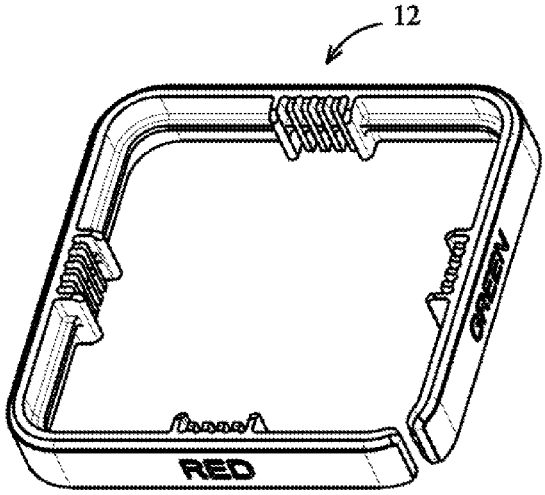
FIG. 27A is a view showing a square ring assembly puzzle in a perspective view in accordance with the present invention.
Figure 27B:
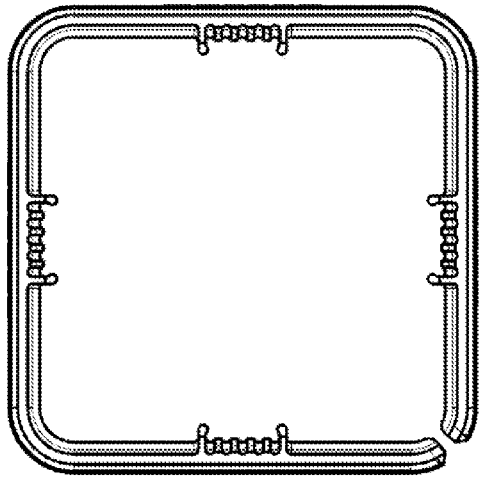
FIG. 27B is a front view of a square ring assembly puzzle in accordance with the present invention on FIG. 27A.
Figure 28A:
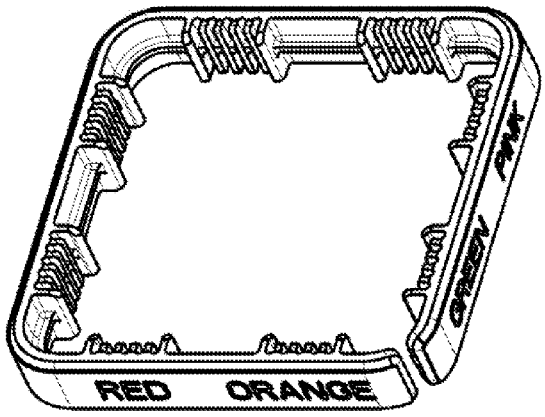
FIG. 28A is a view showing a rectangular shape octagon ring assembly puzzle in a perspective view in accordance with the present invention.
Figure 28B:
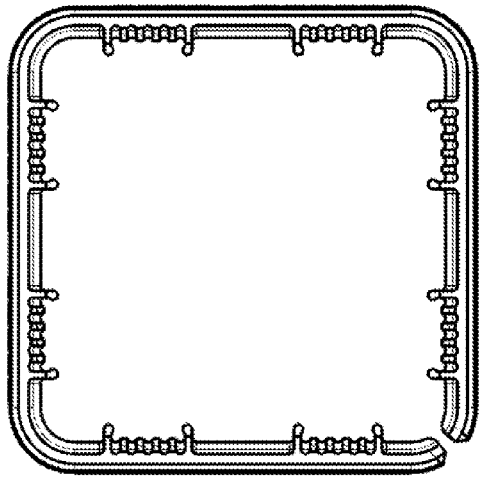
FIG. 28B is a front view of a rectangular shape octagon ring assembly puzzle in accordance with the present invention on FIG. 28A.

Number of groups of locking means like groups of two rounded protrusions 4 and grooves 5, can be any, for example four locking means shown on FIGS. 27A and 27B, five locking means shown on FIGS. 26A and 26B, six locking means shown on FIG. 1, eight locking means shown on FIGS. 28A-29B.

The inventive puzzle operates in the following manner.

The object of the puzzle is to create different shapes and structures by connecting the ring assemblies with the same or different shapes and to build structure by connecting the rings so that the colors on the rings match at the position where they are connected.

Two ring assemblies 1 in process of engagement are shown on FIG. 6A. After engagement as shown in FIGS. 6B and 7 this process to create different shapes is multiplied many times per player's choice by coupling of structures as shown in FIGS. 8-25D, 30A-33B.

Structures can be not only architectural or geometrical 3D constructions as shown on FIGS. 8-17, 23A-25C, but also they can form animals, flowers, bugs, kids as shown on FIGS. 18-22.

Because of cut 9 each ring assembly 1, 11, 12, 13 and 14 is flexible and has additional resistance to keep multiple rings engaged.

Figure 33A:
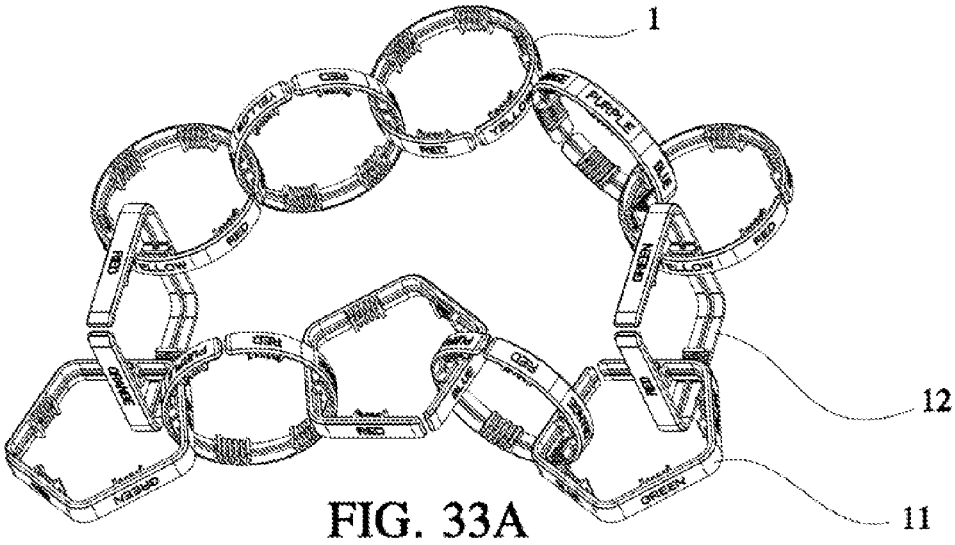
FIG. 33A is a perspective view of a sample of twelve combined with different shapes ring assemblies in process to be locked together.
Figure 33B:
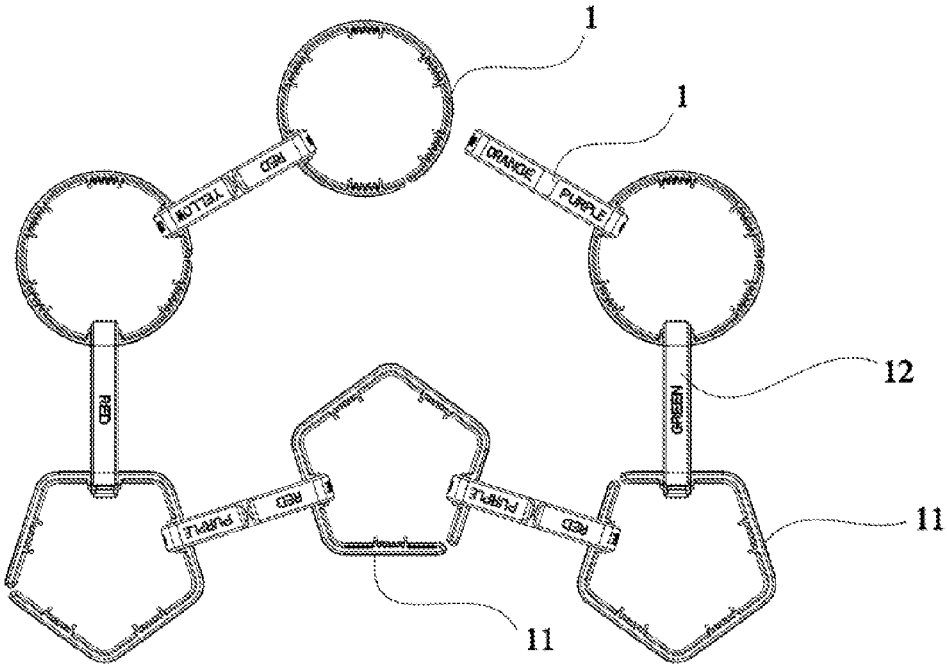
FIG. 33B is a front view of a sample of twelve combined with different shapes ring assemblies in process to be locked together on FIG. 33A.

Assembled from ring assemblies structures are flexible and resistant and can be easily locked into closed chain even if assembled structures with rings have different shapes as shown on FIGS. 33A and 33B.

Player can build just about anything with a little difficulty and with rings of different or the same shapes. Depending of the shape and size of design, challenge can range from very easy to very difficult.

It will be understood that each of the elements described above, or two or more together, may also find a useful application in other types of constructions differing from the type described above.

While the invention has been illustrated and described as embodied in a ring puzzle, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

The invention claimed is:

1. A ring puzzle, comprising a plurality of rings, each of said rings having an inner surface and a through going slot through which said rings can be introduced into one another, each of said rings being provided on said inner surface with a plurality of groups, each of said groups including two peripherally spaced protrusions having rounded ends which are spaced from said inner surface and facing toward each other and also including two corresponding transversely spaced rounded grooves located on opposite side surfaces of said ring and facing toward each other, such that when one of said rings is introduced into another of said rings and turned relative to the latter and said rounded ends of said two peripherally spaced protrusions of one of said rings are engaged into said rounded grooves of another of said rings of at least one of said groups, said two rings become firmly connected with one another.

2. A ring puzzle as defined in claim 1, further comprising a projection extending between said protrusions of each of said groups and having a flat inner surface, said rounded groves being provided in said projection.

3. A ring puzzle as defined in claim 2, where a distance between said flat inner surface of said projection to a center of each of said rounded grooves is equal to a distance between said flat inner surface of said projection and a center of said end rounded ends of said protrusions.

4. A ring puzzle as defined in claim 2, wherein edges between outer opposite surfaces and said flat inner surface of each of said projections are rounded.

5. A ring puzzle as defined in claim 1, wherein each of said rings has a reinforcing rib provided on said inner surface and extending between said groups in a peripheral direction.

6. A ring puzzle as defined in claim 1, wherein each of said rings is flexible and said slot of each of said rings enhances its flexibility.

7. A ring puzzle as defined in claim 1, wherein when said one ring is introduced into said another ring and turned relative to the later and said two rings become firmly connected with one another said ring, puzzle becomes three-dimensional.

* * * * *